US007172176B1

(12) United States Patent
Eastland

(10) Patent No.: US 7,172,176 B1
(45) Date of Patent: Feb. 6, 2007

(54) COLLAPSIBLE CROWD CONTROL BARRIER

(75) Inventor: Erik Eastland, Bend, OR (US)

(73) Assignee: All Access Staging and Productions, Inc., Torrance, CA (US)

( * ) Notice: Subject to any disclaimer, the term of this patent is extended or adjusted under 35 U.S.C. 154(b) by 0 days.

(21) Appl. No.: 11/361,545

(22) Filed: Feb. 24, 2006

(51) Int. Cl.
*E04H 17/14* (2006.01)

(52) U.S. Cl. ..... 256/26; 256/31

(58) Field of Classification Search ..... 256/1, 256/26, 31; 404/6; 49/176, 195; 160/351
See application file for complete search history.

(56) References Cited

U.S. PATENT DOCUMENTS

| | | | | |
|---|---|---|---|---|
| 3,490,749 | A | 1/1970 | Anderson | |
| 3,630,491 | A | 12/1971 | Puccio | |
| 4,712,773 | A * | 12/1987 | Larson | 256/25 |
| 4,909,483 | A | 3/1990 | van Herpen | |
| 5,213,312 | A | 5/1993 | MacDonald | |
| 5,356,119 | A | 10/1994 | Schock | |
| 5,779,227 | A | 7/1998 | Elkins et al. | |
| 6,079,904 | A | 6/2000 | Trisl | |
| 6,296,234 | B1 | 10/2001 | De Boer | |

OTHER PUBLICATIONS www.mojobarriers.com/products/alu.htm; The Mojo Barriers, "Mojo Aluminium Barrier", last viewed on Apr. 17, 2006, (1 page).
Beck, Michael A., www.mojobarriers.com; "Who Knew?", As Seen On U2's Vertigo Tour, Tour Guide Journal, (1 page).
Brochure—Pitstop Barriers, "Aluminum Barricade System", Patch Park Farm, England, (2 pgs).
Brochure—Pitstop Barriers, (6 pgs.).
Flyer—Pitstop Barriers, (1 pg.).
Brochure—Prolyte Products, "Prolyte Barrier Safe Performance For Any Crowd", (2 pgs.).
Newsletter—Prolyte News, "New Product: Prolyte Barrier", No. 22, Sep. 2004, (1 pg.).
Brochure—The Mojo Barriers, "The Mojo Barrier Safe and Strong with Total Flexibility", (2 pgs.).
Brochure—Nordic Staging ApS, "Nordic Crowd Barriers", (3 pgs.).
Brochure—Versa Stage, "Versacade", All Access Staging & Productions, Torrance, California, (2 pgs.).

* cited by examiner

*Primary Examiner*—Gary S. Hartmann
(74) *Attorney, Agent, or Firm*—Fulwider Patton LLP

(57) ABSTRACT

A modular crowd control barrier that is collapsible includes a rounded top rail and a rearward projecting horizontal boss with a bore and axel. The axel of one barrier connects to the respective bore of an adjacent barrier. A hinged gate with a latch and catch may pivotally connect adjacent barriers to each other.

9 Claims, 6 Drawing Sheets

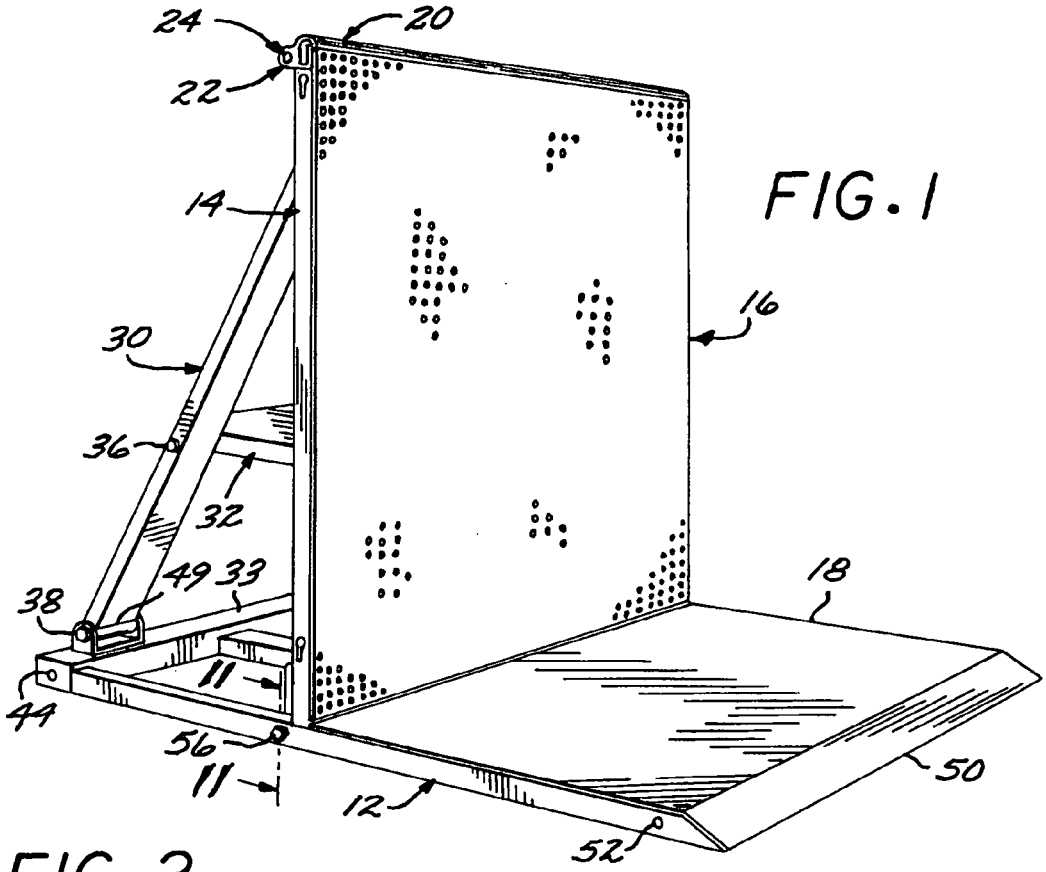
FIG. 1
FIG. 2
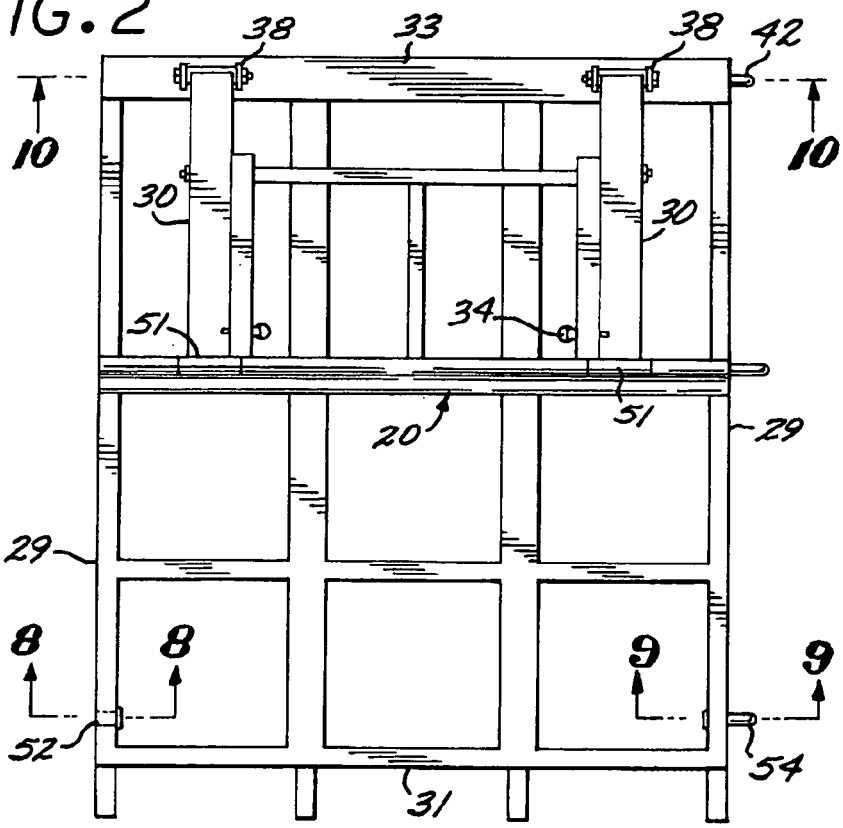

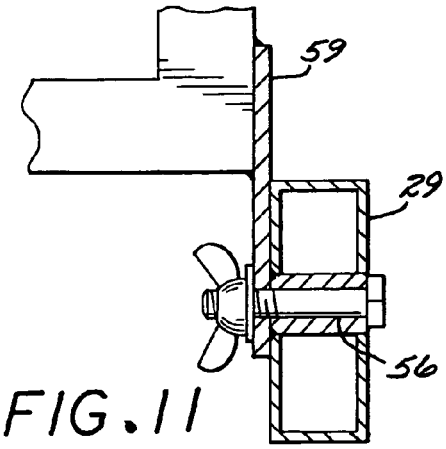
FIG. 11
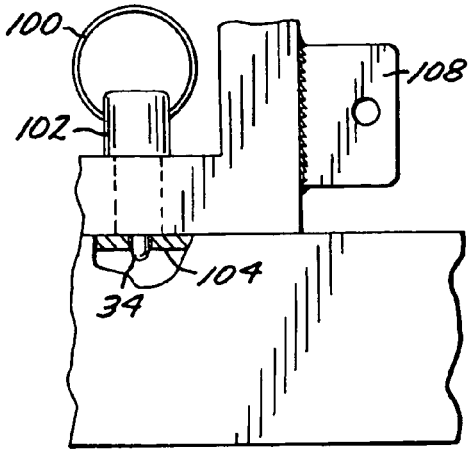
FIG. 13
FIG. 12
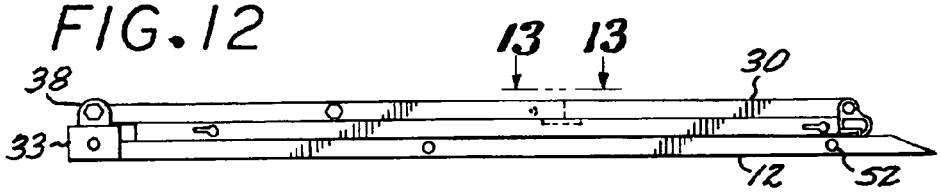
FIG. 14
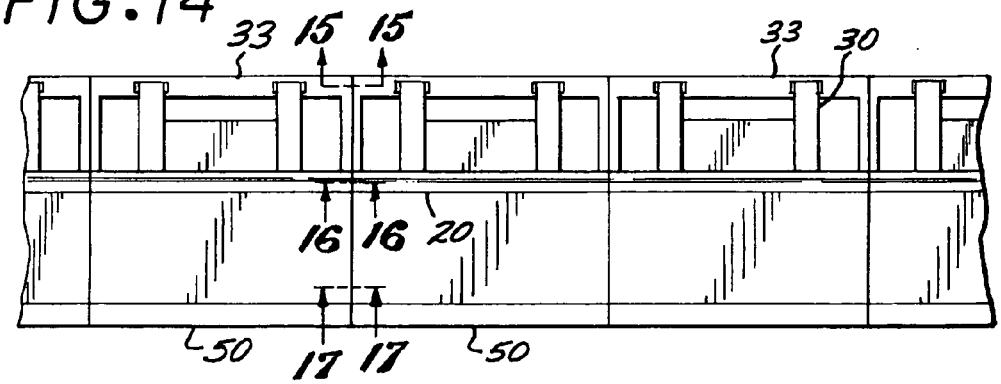
FIG. 15
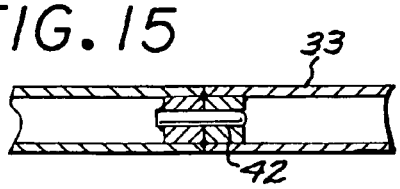
FIG. 16
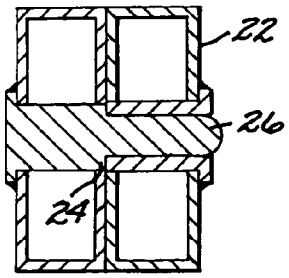
FIG. 17
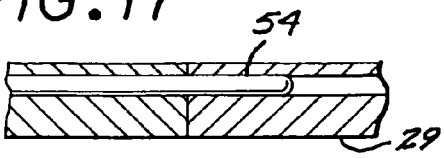

FIG. 18
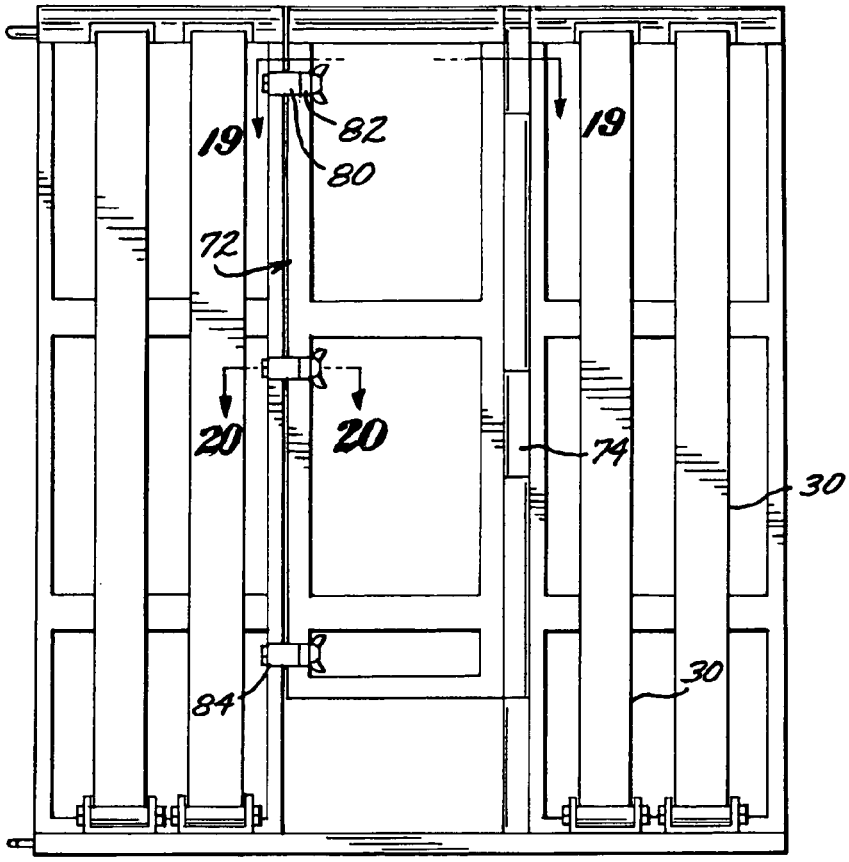
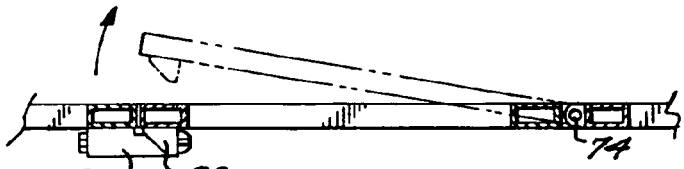
FIG. 19
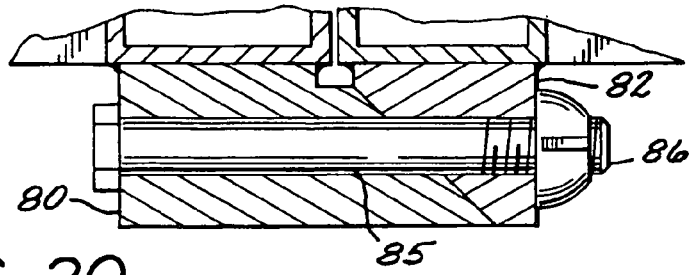
FIG. 20

FIG. 21
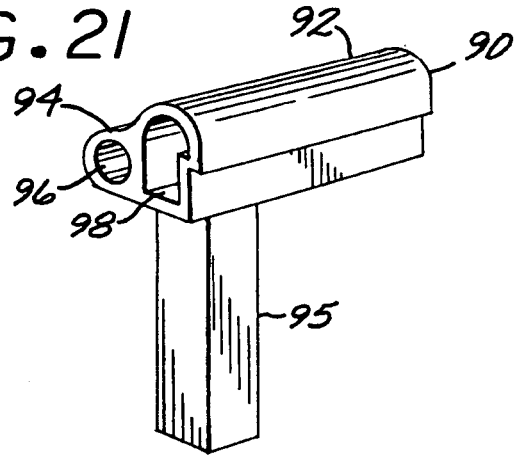
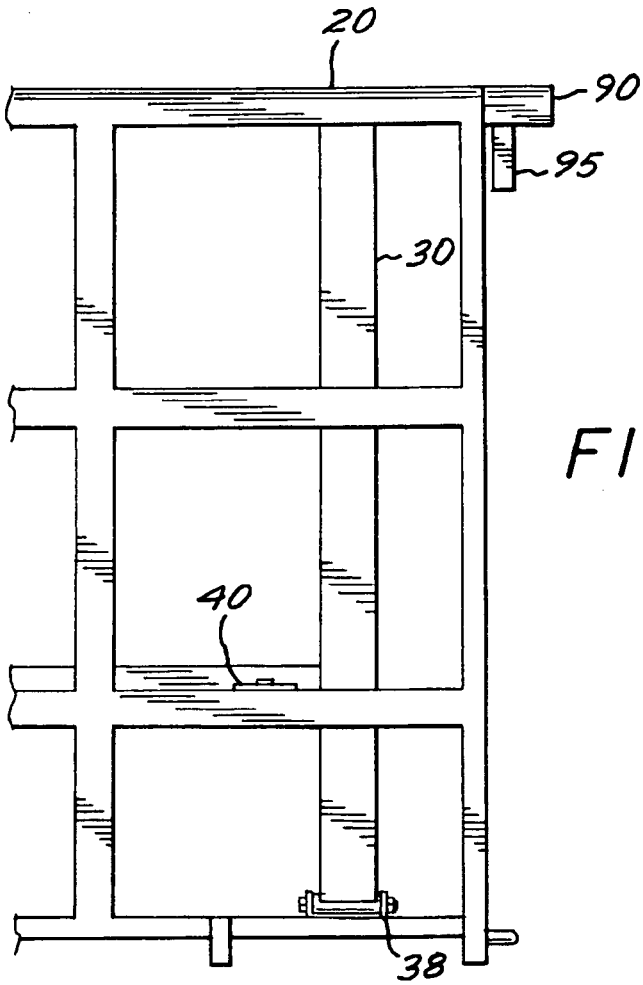
FIG. 22

COLLAPSIBLE CROWD CONTROL BARRIER

FIELD OF THE INVENTION

The present invention relates to a crowd control barrier that is easily configured for connecting to adjacent barriers and for storage and handling.

BACKGROUND OF THE INVENTION

The field of crowd barriers has evolved according to the needs of the situation. From simple wooden barricades to chain link fencing, crowd barriers have been developed to regulate and partition people from specified areas. While wooden barricades have been useful for signaling where one should not enter and are easy to setup, their ability to stop someone has largely been ineffective. Likewise, barriers such as fencing are effective at stopping a few people but are difficult to set up and remove, and have proven largely ineffective at events with large crowds were tragically, masses of people easily rock the fences until they crash and people are crushed by the crowd. Crowd control barriers require a sturdy construction while also needing simple setup and breakdown characteristics and versatility in their configurations.

At large scale events such as music concerts or sports events, an effective crowd control barrier must withstand both an onslaught of people wishing to get past the barricade during the event and the rigors of handling and transportation before and after the event. While many metal barriers of sturdy construction have been previously developed, such barriers were relatively heavy demanding considerable labor to set up and move about. Barriers with lightweight metal such as aluminum were then developed, and while lighter, lacked endurance or were cumbersome to manipulate. The present invention is directed to a lightweight crowd control barrier that is easy to handle, can shift from a compact collapsed position to a fully erect position in short time, and can easily connect to other barriers to form a sturdy barricade that may be configured in a non-linear formation.

It has long been recognized that connecting multiple barriers in sequence is a desirable feature that allows the formation of a longer barricade with other barriers of the type. In recognition of this problem, it has been proposed to construct barriers with the ability to link to an adjacent barrier of the same type. A barrier of this type is shown in U.S. Pat. No. 3,630,491 to Puccio.

At present, connection between barrier modules vary from bolting to using cotter pins or simple latches as seen in Puccio. To serve their purpose, the connectors must be quick and efficient for rapidly setting up strings of barriers, while being durable to withstand the forces exerted at the joint of two connected barriers.

The problem with the construction of barrier modules at present is that to meet durability requirements most are made of heavy material such as steel making them inefficient for handling and connecting together to form a barrier line. Steel constructed barriers, while sturdy, are often constructed with rectangular tubing and are overall difficult to grasp. Gripping a heavy rectangular surface while trying to connect two barriers together requires considerable effort and often results in the workman losing the frame causing it to fall and take damage.

Another problem with barrier connectors is the sturdiness of the connector itself. While simple latches and pins may be sufficient to link barrier modules together, such a solution fails to provide durability against forces generated by a large crowd. The latches and cotter pins tend to break or bend when resisting the crowd forces. Hence, many of such barriers were more of a deterrent than a crowd stopping device.

It is known to form a horizontal bottom frame and barrier frame pivotable upwardly therefrom and braced from the rear by pivotal struts. A device of this type is shown in U.S. Pat. No. 6,296,234 to De Boer. Such devices suffer the shortcoming that the connector of the pivotal struts to the top o the barrier frame are incapable of withstanding high crowd forces and are themselves inexpensive to make. Connectors between the barrier modules often lock load carrying capability and many require time to assemble. Such connectors are unsuitable for concert venues where set up and breakdown time is very limited.

Another problem with barriers of the present is their lack of user friendliness. Security is often located behind the barriers in case someone is able to get past one but that limits the security from being able to access the crowd if needed. To solve this problem, security will often stand elevated above the crowd behind the barriers using boxes or other stand alone platforms. To solve this problem, De Boer proposed using a step connected to the barrier so that security personnel may stand on the barrier elevated to a crowd where they may spot specific activity in the crowd.

The problem with the De Boer solution is that while security personnel may be elevated above the crowd, such a barrier design does not take into account the fact that personnel must stand on the step without upper body support, often for an extended period of time. While De Boer shows a rounded rail top wall on which a workman may arguably rest his or her hand, it is challenging to maintain a grip on such a singular surface for extended periods of time.

The De Boer design also lacks a feature which enables security personnel to exit from behind the barrier and return effectively. While personnel may be able to spot problems in the crowd, getting access to those problems from behind a barrier is another issue, as is returning to the secure side of the barrier. There are times when a spectator is hurt or feints in a crowd and security faces a daunting task of accessing the crowd to reach the person and then retreating back around the end of the barrier to a safe area. While security personnel may scale the barrier from the security side to enter the crowd, such a maneuver risks further injury to the security personnel and to members of the crowd.

Another problem with barriers of today is the inflexibility of configuring them to the shape of the perimeter of the area to be protected. Today's barriers are cumbersome and lack adaptability to the non-linear perimeters of many venues. For instance, when an area requires a barricade to form a semi-circular formation or right angles at any point, the previously proposed barriers fail to provide an effective and efficient means of linking adjacent barriers to achieve this purpose.

In unrelated areas such as baby barriers and water barriers, it has been known to construct lightweight, easily handled and easily set up collapsible barriers. Such barriers are not suitable for the regulation of large crowds of people because they're construction is either too lightweight or ineffective at keeping people out of a restricted area. For example, the baby barrier uses plastic which will not endure against the force of one adult let alone a crowd. As another example, a water barrier uses an impermeable sheet as a barrier surface against water. Such a sheet is easily compromised and people will be able to pass through the barrier at will.

Thus, a need exists in the marketplace for a crowd control barrier modules that is easily handled, easily and durably connected to adjacent barrier modules, and can be configured to non-linear formations while maintaining a durable integrity.

SUMMARY OF THE INVENTION

Briefly and in general terms, the present invention is directed to a modular barrier that is used to control crowds at various scenes and events by providing a tubular top rail with a rearward projecting boss that defines a tubular wall which includes a horizontal bore, a journal bore and an axel and is formed with longitudinal spaces for struts. Crowd control barriers require a durable resistance to the forces generated by a surging crowd but yet constructed to be easily and rapidly deployed and connected together. Many largely populated events require security to be present behind the barriers for extended periods of times. For this embodiment, a step is provided to allow security to stand on the barrier elevated to see above a crowd. The formation of the top rail and tubular wall create an efficient surface for gripping in both the sense that one may easily hold the barrier there when connecting it to an adjacent one and in the sense that it provides a comfortable and sturdy support to grip for security when standing on the barrier step.

Various secure barricade configurations may be formed with the barrier. In one embodiment, the barrier module includes a hinged gate hung from the barrier frame. The hinged gate opens and can be set at an angle to the frame to connect on its free side to an adjacent barrier module when an angular barricade line is undesirable. The gate includes a latch block that abuts a block catch on the frame along abutting surfaces which angle at an oblique angle to the path of rotation of the gate to, upon abutting form a relatively low profile thickness so as to minimize any obstruction when folded down on the base.

The hinged gate also provides a pathway by which security personnel may cross from the safe area side of the barrier into the crowd area side freely without incurring the risk of scaling over the barrier and injure themselves or others and conveniently return to the safe area side without having to go all the way around to the ends of the barrier.

Other features and advantages of the invention will become apparent from the following detailed description, taken in conjunction with the accompanying drawings which illustrate, by way of example, the features of the invention.

BRIEF DESCRIPTION OF THE DRAWINGS

FIG. 1 is perspective view showing the barrier apparatus of the present invention in a fully erect position;

FIG. 2 is a top view, in enlarged scale of the barrier shown in FIG. 1 but with the cover sheeting for the base and step removed;

FIG. 11 is a partial vertical sectional view, in enlarged scale, taken along the 11—11 of FIG. 1;

FIG. 12 is a left side of the barrier apparatus shown in FIG. 1 but in its collapsed position;

FIG. 13 is a partial broken top view, in enlarged scale, taken along the lines 13—13 in FIG. 12;

FIG. 14 is a top plan view, in reduced scale of multiple barrier modules shown in FIG. 1 connected together;

FIG. 15 is a partial cross-sectional view, in enlarged scale, taken along the lines 15—15 of FIG. 14;

FIG. 16 is a partial cross-sectional view, in enlarged scale, taken along the lines 16—16 of FIG. 14.

FIG. 17 is a partial cross-sectional view, in enlarged scale, taken along the lines 17—17 of FIG. 14;

FIG. 18 is a back view of a second embodiment of the two barrier module of the present invention;

FIG. 19 is a horizontal sectional view taken along the line 17—17 of FIG. 17; and FIG. 20 is a partial horizontal sectional view, in enlarged scale, taken along the line 20—20 of FIG. 18.

FIG. 21 is a perspective view of an end cap used on the barrier apparatus shown in FIG. 1;

FIG. 22 is a front sectional view depicting the end cap in use on the barrier apparatus shown in FIG. 1.

DETAILED DESCRIPTION OF THE PREFERRED EMBODIMENTS

Figure 6:
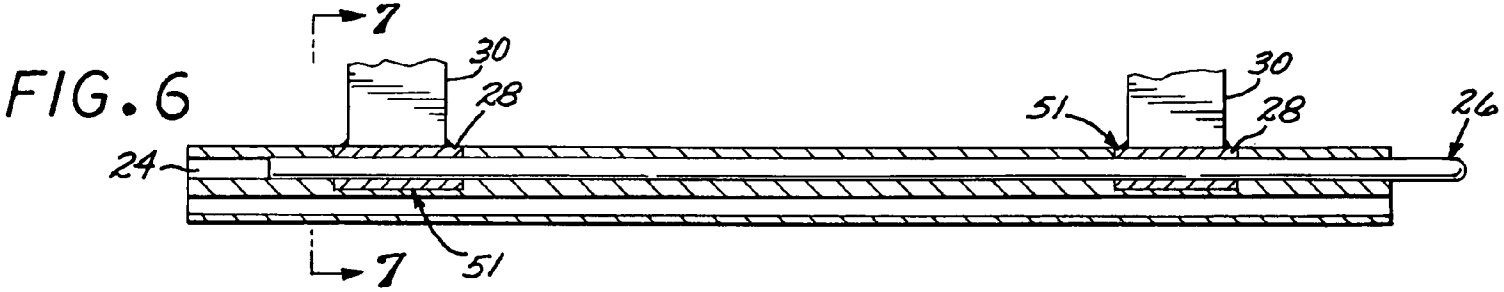
FIG. 6 is a longitudinal sectional view, in enlarged scale, taken along the line 6—6 of FIG. 4.
Figure 9:
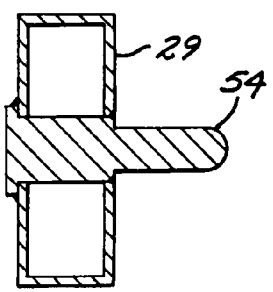
FIG. 9 is a longitudinal sectional view, in enlarged scale, taken along the line 9—9 of FIG. 2.
Figure 8:
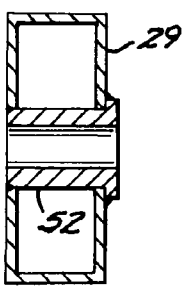
FIG. 8 is a horizontal sectional view, in enlarged scale, taken along the line 8—8 of FIG. 2.
Figure 7:
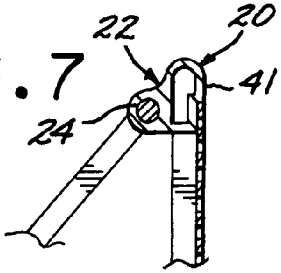
FIG. 7 is a transverse sectional view taken along the line 7—7 of FIG. 6.

Referring to FIGS. 1, 6 and 7, the modular crowd control barrier 10 of the present invention includes generally, a base frame 12 surmounted by a barrier frame 14 pivotable from an erect to a collapsible position shown in FIG. 12. The barrier frame is braced on its erect position by pivotally mounted struts 30. The barrier frame is of tubular construction and includes a hollow horizontal load bearing, rounded top rail 20 and a structurally integrated rearward projecting boss formed by a tubular wall 22. The tubular wall 22 defines a horizontal journal bore 24 and is formed along its length with longitudinally spaced, longitudinal clearance slots 28 receiving the upper extremities of the struts 30 (FIG. 1). An elongated axel 26 is received in the horizontal bore 24 to partially connect the upper ends of such struts in place (FIG. 1).

Referring to FIGS. 1 and 2, the horizontal base 12 is constructed of rectangular aluminum tube members to form a pair of longitudinal side tubes 29 connected at the respective front and rear extremities by front and rear cross tubes 31 and 33. The rear tube 33 mounts a pair of spaced devices 35 for receiving the lower extremities of the respective struts. The rear tube is formed on one end with an open end and mounts a laterally projecting dowel pin 42 on the other end. Referring to FIG. 1, the left side member is formed near its front extremity with a laterally opening bore. A dowel pin 54 is mounted on the other side member 29 along the transverse axis of the bore 52 so that the dowel pin will fit into a corresponding bore on an adjacent barrier module of the same construction. The forward section of the base is covered by an aluminum plate 18 which may be formed with a downwardly chamfered front extremity 50. The chamfer provides a safety feature minimizing the stumbling that occurs when that edge is frequently kicked because of the thickness of base 12 and its exposure to the crowd from the pushing and shoving of a crowd up near a barrier.

Figure 3:
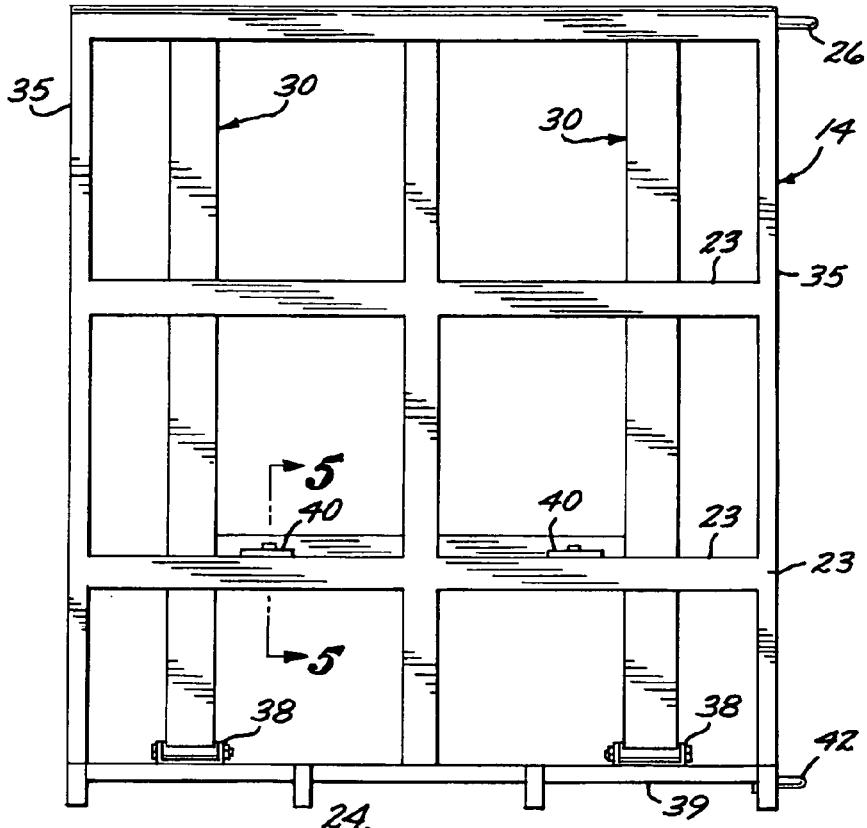
FIG. 3 is a front view, in enlarged scale, of the barrier apparatus shown in FIG. 1.
Figure 4:
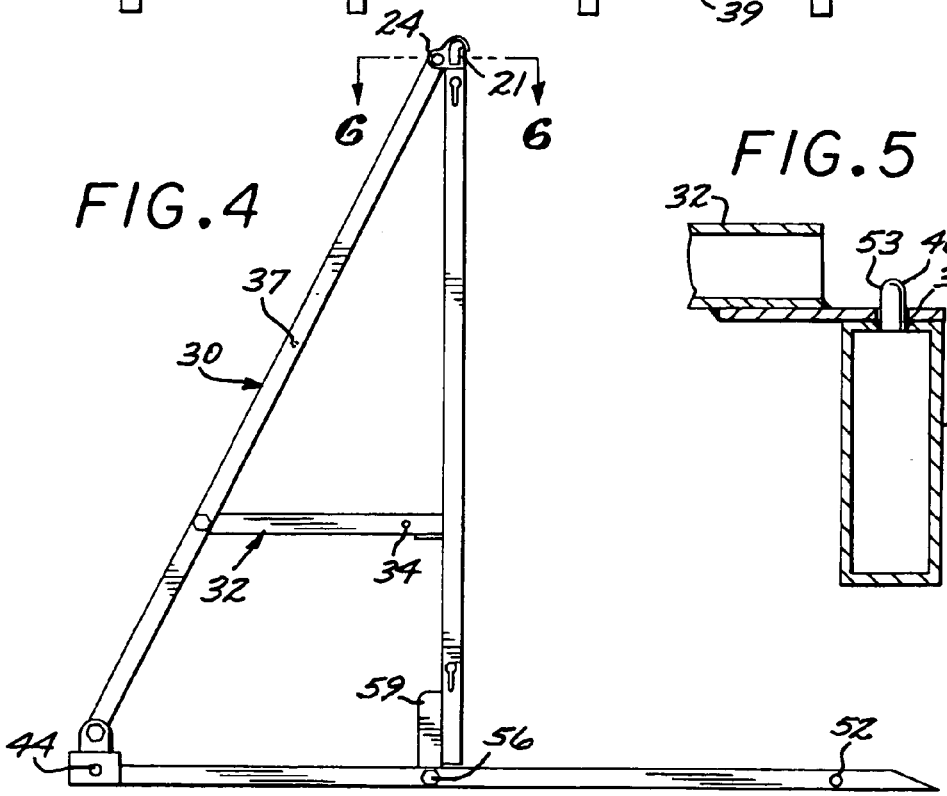
FIG. 4 is a left side view, in enlarged scale, of the barrier apparatus shown in FIG. 1.

Referring to FIG. 3, the barrier frame 14 is typically constructed of tubular parallel side members 35, the top tube 20 and lower tube 39 and intermediate cross rails 20, the lower rail 20 mounting a pair of horizontally spaced apart upstanding anchoring dowels 40. Referring to FIGS. 4 and 7, the top wall 20 is formed with a cylindrical dome and a vertical front wall 41 undercut to form a downwardly facing shoulder 21 to receive the top marginal edge of the barrier cover sheet 16 by extruding to form the overall beam of integral construction. Those skilled in the art will appreciate that the integrated construction offers an efficient weight to load bearing ratio to withstand high loads. On an end barrier of a barrier wall, an end cap may be used to cover the axel. The wall of the boss preferably melted to form clearance slots 28 spaced laterally along to received the upper extremities of the struts (FIG. 6).

Referring to FIGS. 2–3 and 6, the axel 26 projects laterally approximately three inches from one end of the tubular wall 22 to form a connector stub 27 and stops short or the opposite end to leave a socket 24 telescopical receipt of the connector stub of the adjacent.

The struts 30 include cylindrical bosses 49 and 51 at the lower and upper extremities, respectively to connect to the cleats 38 and to be received in respective clearance slot 28 to align with journal bore 22 for receipt of the axle.

Referring to FIGS. 1 and 3*a*, step 32 plate is pivotally connected on its rear extremity between the struts 30 at the height of the lower support rail 23 so that the free extremity thereof will pivot into position resting on such rail. The free extremity of the step mounting tab 35 that is formed with a pair of bores 53 is to fit over the dowels 40 when the step is in its lowered position shown in FIGS. 3 and 5.

Referring to FIGS. 1 and 4, the barrier is further formed with an ear 59 at a bottom extremity that includes a bore. The base is also further formed with a corresponding bore at a point on the side members of the base that coincides with the bore on the ear of the barrier. A bolt 56 is insertable through both bores to assist in supporting the barrier frame in a vertical position. Those skilled in the art will appreciate that using a bolt in such a point will increase the elastic modulus of the frame and minimize any shear lag that may occur when the forces created by large crowds of people pushing on the barrier cause stresses on that point.

In situations where a access between barriers is desirable, one embodiment helps alleviate that problem by including a barrier frame 14 further formed with a gate frame 70 that includes a gate opening having a hinge side and a latch side. Referring to FIG. 18, a gate frame 70 includes a gate 72 that is pivotable about a hinge 74. The gate includes a latch block 82 while a free side of the gate frame includes a catch block 80. The latch block 82 moves through an arc when the gate is rotated between positions. A catch block 80 is mounted on the latch side of the frame and is disposed along the predetermined path of the latch block 82 so that when the gate is in a closed position, the latch block 82 confronts the catch block 80 and are fastened together.

Referring to FIG. 21 an end cap 90 is formed with a top rail 92, a rearward projecting boss 94, an axel bore 96, stem 95 and a top rail bore 98.

It will be appreciated that the apparatus is collapsible making it convenient for shipping to a desired destination where it can be quickly and efficiently erected. To provide collapsibility, the bolt 56 is removable from the base and barrier frame and the struts 30 are moveable coextensive with the barrier frame 14 so that the struts 30 pivot at the strut bores 29 at one extremity and at cleats 38 at the rearward section of the base. The step 32 may swing away from the dowels 40 into a secured position coplanar to the struts 30 by using a lock pin 34 that secures the step 32 to the struts 30 via through holes 37 located on the struts 30 an underside of the step. Thus, the barrier is easily collapsed for storage and delivery and re-erected using the reverse of this process.

Figure 5:
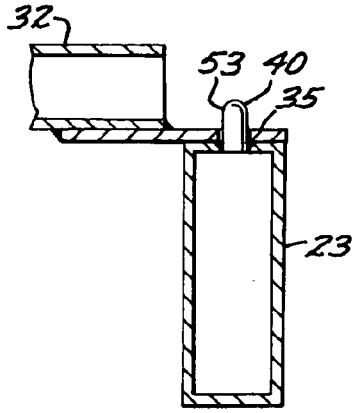
FIG. 5 is a sectional view, in enlarged scale, taken along the lines 5—5 of FIG. 3.

When ready for use, the barrier 10 is raised into an erect position with the barrier frame 14 being vertical, the struts 30 simultaneously pivot and rise from a horizontal point to an angle sufficient to provide support to the barrier frame 14 in its vertical state. Rail support from rails 23 assist in providing structural integrity to the interior of the barrier frame. The rail supports also provide locations for placement of the upright dowels 40 thereby helping define the desired height of the step. As illustrated in FIGS. 3–5, a step 32 may remain secured attached to and coplanar to the struts 30 by a lock pin 34 or released to a horizontal position parallel to the base 12 where it is secured to dowels 40 on a support rail 23 by a mounting tab 35. The step 32 in its horizontal position provides not only a firm and secured platform for standing upon or resting other objects, but simultaneously provides extra structural support for the barrier frame 14 in its vertical position. A bolt 56 inserted into bores where the barrier coincides with the bore of the ear 59 provides further structural support for the barrier frame while simultaneously providing a quick release/fastener point. Those skilled in the art will appreciate that the combination of hinged struts, hinged step, support rails and a bolt simultaneously provide a superior durable barrier structure at stress points while simultaneously providing for quick and efficient erection or collapse of the apparatus.

Figure 10:
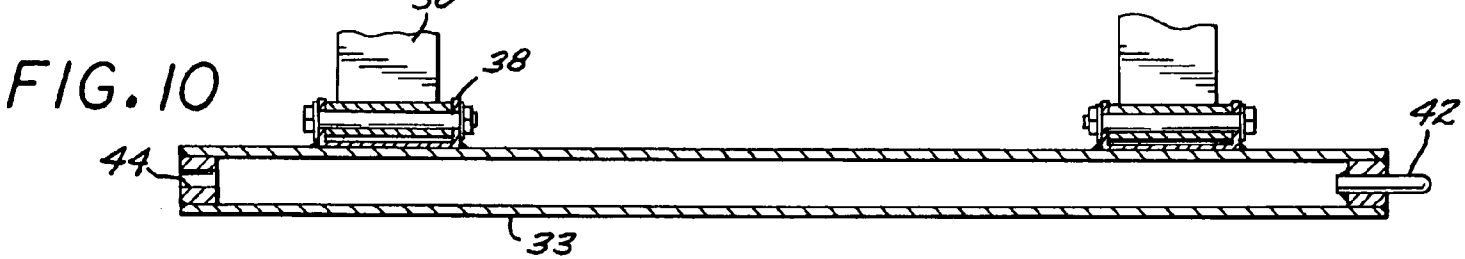
FIG. 10 is a longitudinal sectional view taken along the line 10—10 of FIG. 2.

The barrier 10 may be handled or stored in a collapse position as seen in FIG. 12. To collapse the barrier, the bolt 56 is removed from the base and barrier frame. The step 32 swings upwardly away from the dowels 40 and is secured by a spring biased lock pin 34 into position between the struts 30 using through holes 37 located on the struts 30 and on the underside of the step. The struts 30 are moved coextensive with the barrier frame 14 so that the struts 30 pivot at the strut bores 29 at one extremity, FIG. 6 and at cleats 38, FIG. 10, at the rearward section of the base causing the top rail to move toward the front section of the barrier where the barrier surface 16 will rest facing the platform surface 18. The lock pin 34 is receivable within the confines of the barrier frame when collapsed as illustrated along lines 13—13 in FIG. 12.

When fully erect, the barrier 10, in one embodiment may be connected to adjacent barriers at various points as illustrated in FIGS. 14–17. As stated previously, the stub socket 24 and axel 26 combination secure adjacent barriers where the rearward projecting tubular walls 22 meet. A bore 44 and interlocking dowel pin 42 from adjacent barriers also connect at the rearward section of the base 12. Similarly, a bore 52 and interlocking dowel 54 secure adjacent barriers at the forward section of the base 12. In one embodiment, where a barrier is the last barrier along a wall, the axel may be covered by using an end cap. The end cap contains a bore for inserting the axel into and a bolt for inserting into a key slot formed along a side member of the barrier and locking the end cap into place. It will be appreciated that the end cap serves to protect the crowd by covering the axels that would otherwise remain exposed at the end of a barrier wall.

Referring to FIGS. 18 and 19 the catch block 80 and latch block 82, in one embodiment, are formed with confronting parallel abutting surfaces that project at an angle relative to the radius of the predetermined path of the latch lock 82, typically one that is 45°. A through bore 85 allows a plunger 86 (FIG. 20) to project through the through bore 85 for fastening the latch block 82 with the catch block 80. It will be appreciated, given the forces a large crowd can have on barriers, that gates with latch blocks afford high integrity strength and resistances to stresses under shear loads.

Referring to FIGS. 21–22, and end cap 90 allows the axel to be covered on a barrier at the end of a multiple barrier connection. It will be appreciated that this end cap serves as a safety feature protecting the crowd from running into an exposed axel.

In practice, the modular crowd control barrier 10 is lightweight sturdy structure that provides easy handling, connectivity between multiple barriers, and efficient storage capabilities. In a preferred embodiment, referring to FIGS. 1 and 6–10, the top rail 20 and the projecting boss that defines the wall 22 are generally tubular. As seen in FIGS. 6 and 7, the top rail 20 is a hollow load bearing rail with a round dome surface. One will appreciate that this tubular formation allows security personnel to easily grip the top rail 20 and tubular wall 22 combination when standing atop the stop 32 seen in FIGS. 1 and 4. Such a structural formation provides extra support and comfort to a person who must stand atop the barrier step 32 and will eventually lean on the rail and tubular wall for hours on end while scanning a crowd of people. Furthermore, such a tubular construction allows for easier handling of the barriers when erect and being connected to each other by the axels 26. A tubular top rail and tubular wall combination provide better grippage when connecting adjacent barriers than does a rectangular top rail or a single tubular one for that matter. The surface between the top rail and rearward projecting tubular wall provides an area for fingers to gain traction and grip while a rectangular or a single tubular rail lack any gripping surface.

Once the formation of the barrier wall is known, adjacent barriers may be positioned and connected using either the journals, pins, and bores and/or using the hinged gates with the latch and catch combination. It will be appreciated to one skilled in the art that the gate 72 provides access for ingress and egress of the crowd area. The gate may be constructed suitably wide to permit individuals to use the gates to cross through the barriers at various points along a barrier wall. Those skilled in the art will recognize the need for security personnel to efficiently cross through the barrier to access certain individuals and the need to quickly and efficiently return back to the security side of the barrier wall without the burden of circumventing the entire length of barrier wall.

It will also be appreciated that such angled surfaces on the latch and catch blocks create a low profile that allows the latch to be receivable within the confines of the base plate when the barrier is in a collapsed position. When the latch is receivable within the open areas of the base, such a profile cooperates with the overall structure of the barrier to provide a compact design that can be easily collapsed into a low profile package that is quickly and efficiently handled and stored. This is distinguishable from other latches that are of standard construction which lack the profile necessary to fit with the rest of the barrier when collapsed and thus interfere with collapsibility and storage.

It will be appreciated that the present invention will provide an adaptability to conform to the various situations it can be put to use. Each event and venue contains its own needs for crowd control because of the various landscapes and technical aspects of each show. As will be apparent to those skilled in the art, the present barrier system can configure multiple barriers into a non-linear formation while maintaining structural integrity with ease of setup, breakdown, and storage.

From the foregoing, it will be apparent that the modular crowd control barrier module of the present invention with the tubular top rail and integrated axel boss provides an efficient sturdy structure to withstand crowd surge forces. The embodiment with the axel projecting from one side to be received in an axel bore socket in an adjacent module affords quick set up and high integrity coupling. The gate and low profile and catch blocks allow for compact nesting in the collapsed position.

I claim:

1. Modular crowd control barrier apparatus comprising:

a horizontal base;

an elongated barrier frame pivotally connected on one extremity medially to the base to divide the base into a forward section and rearward section, and pivotal from a collapsed position coextensive with the base to a raised vertical position, the frame formed with a horizontally projecting hollow load bearing extruded top rail defining when said frame is in its vertical position, a rounded top surface, and configured with a rearward projecting tubular wall defining a horizontal journal bore, the wall formed along its length with a predetermined number of longitudinally spaced apart, rearward opening clearance slots;

a predetermined number of struts releasably connected on their respective one extremities to the rearward section of the base and angling, when the frame is in its raised position, upwardly toward the top rail in a support position, and configured at their respective top extremities with the bosses received in their respective clearance slots and formed with respective strut bores aligned with the journal bore;

a journal received in the journal and strut bores to pivotally connect the respective upper extremities to the top rail.

2. The crowd control apparatus of claim 1, wherein:

the barrier frame is formed with a gate frame defining a gate opening having a hinge side and a latch side;

a gate received in the opening, hinged to the hinge side of the frame to rotate forwardly from the opening to an open position and including on a free side a latch block moved through a predetermined path when the gate is rotated from its open position to a closed position in the opening;

a catch block mounted on the latch side of the frame and disposed in the predetermined path;

the latch and catch blocks being formed with confronting parallel, abutting surfaces projecting at an acute angle relative to the radius of the predetermined path; and a fastener for fastening the latch and catch blocks together.

3. The crowd control apparatus of claim 2, wherein:

the latch and catch blocks are formed with a through bore; and the fastener is a bolt operable for receipt of the through bore.

4. The modular crowd control barrier apparatus of claim 1, wherein:

the struts are configured to be, when in the support positions, disposed in a common plane;

the barrier frame includes a cross bar disposed, when the barrier frame is in its erect position, at a predetermined level;

a step plate pivotably connected between a pair of struts and pivotable between a retracted position disposed between the pair of struts in the common plane and having a free side rotatable downwardly to nest on the cross bar; and a lock pin mounted on the stop to engage one of the pair of struts to selectively lock the plate in its retracted position.

5. A barrier apparatus of claim 1 for connection side to side with mating barrier apparatus and wherein;

the axel is of sufficient length and so positioned in the axel bore as to cause the axel bore to form an open ended socket of a predetermined depth on one end and projecting on its opposite extremity beyond the opposite end of the tubular wall a distance corresponding with the predetermined depth.

6. The modular crowd control barrier apparatus of claim 1 wherein:

the top rail is configured to, when the barrier frame is in its vertical position, form a vertically elongated cross section formed with a semi-circular top wall and a vertical front wall projecting downwardly from the semi-circular top wall and configured with a horizontally extended undercut of a selective depth and to define a downwardly facing shoulder and the apparatus further includes a barrier plate configured to cover the barrier frame and including an upper extremity nested into the undercut against the shoulder.

7. The modular crowd control barrier apparatus of claim 1 wherein:

the top rail is of unitary construction.

8. The modular crowd control barrier apparatus of claim 1 wherein:

the top rail is of one piece construction.

9. Modular crowd control barrier apparatus comprising:

a horizontal base of a selected thickness;

an elongated barrier frame pivotally connected on its bottom extremity intermediately from the base to divide the base into a forward section and rearward section, the forward portion being formed with a horizontal clearance opening;

said barrier frame is formed with a horizontally projecting hollow load bearing extruding top rail defining when said frame is in its vertical position, the top rail is configured to form a vertically elongated cross section formed with a semi-circular top wall and a vertical front wall projecting downwardly from the semi-circular top wall and configured with a horizontally extended undercut of a selective depth and to define a downwardly facing shoulder and the barrier frame is further formed with a barrier plate configured to cover the barrier frame and including an upper extremity nested into the undercut against the shoulder, and configured with a rearward projecting tubular wall defining a horizontal journal bore, the wall formed along its length with a predetermined number of longitudinally spaced apart, rearward opening clearance slots;

an axel received in the journal and strut bores to pivotally connect the respective upper extremities to the top rail, said axel is of sufficient length and so positioned in the journal bore as to cause the journal bore to form an open ended socket of a predetermined depth on one end and projecting on its opposite extremity beyond the opposite end of the tubular wall a distance corresponding with the predetermined depth;

a predetermined number of struts releasably connected on their respective one extremities to the rearward section of the base and configured to angle, when the frame is in its raised position, upwardly toward the top rail in a support position and disposed in a common plane and further configured at their respective top extremities with the bosses received in their respective clearance slots and formed with respective strut bores aligned with the journal bore;

the barrier frame further being formed with a cross bar disposed at a predetermined level when the barrier frame is in its erect vertical position, a step plate pivotably connected between a pair of struts and pivotable between a retracted position disposed between the pair of struts in the common plane and having a free side rotatable downwardly to nest on the cross bar, a lock pin mounted on the step to engage one of the pair of struts to selectively lock the plate in its retracted position;

the barrier frame further being formed with a doorframe defining a door opening having respective hinge and latch sides and further being pivotable from an erect position to a collapsed position overlying the rear section with the door opening aligned with the clearance opening;

the barrier frame further being formed with a door configured to be received in the door opening and hingedly connected to the hinge side of the door frame to be, when the barrier frame is in the erect position, pivoted forwardly from an open to a close position;

the door further being formed with a latch block mounted on the free side of the door for and projecting beyond the edge of the door and arranged to travel through a predetermined path as the door is moved from its open to its closed position, the latch block having a horizontal thickness less than the predetermined thickness;

the doorframe further being formed with a catch block mounted on the latch side of the frame and disposed in the predetermined path, the catch block having a horizontal thickness less than the predetermined thickness;

the latch and catch blocks being formed with abutting surfaces angling at an angle substantially 45° to the radius of the radius of the predetermined path and a through bore;

said latch and catch blocks are fastened together by inserting a bolt through the through bore.

* * * * *